US005823352A

United States Patent [19]

Mena et al.

[11] Patent Number: 5,823,352

[45] Date of Patent: Oct. 20, 1998

[54] CONTAINER WITH SHOCK-ABSORBING INSERT

[75] Inventors: J. Joe Mena; Charles F. Johnson; Carol L. Johnson; Gustav M. Maenpaa, all of Colorado Springs, Colo.

[73] Assignee: Summit Container Corporation, Monument, Colo.

[21] Appl. No.: 868,159

[22] Filed: Jun. 3, 1997

[51] Int. Cl.[6] ..... B65D 5/50

[52] U.S. Cl. ..... 206/721; 206/586; 206/594

[58] Field of Search ..... 206/586, 591, 206/593, 594, 521, 701, 719, 721

[56] References Cited

U.S. PATENT DOCUMENTS

| | | | |
|---|---|---|---|
| 987,958 | 3/1911 | Clenny et al. . | |
| 1,817,286 | 8/1931 | Beaman . | |
| 2,401,765 | 6/1946 | Kuhlman . | |
| 2,742,219 | 4/1956 | Van Antwerpen . | |
| 2,979,248 | 4/1961 | Washington . | |
| 2,984,399 | 5/1961 | Gaulke . | |
| 4,241,829 | 12/1980 | Hardy . | |
| 4,327,832 | 5/1982 | de Matteo . | |
| 4,463,851 | 8/1984 | Cecil . | |
| 4,798,290 | 1/1989 | Bradford . | |
| 5,121,838 | 6/1992 | Dickie . | |
| 5,223,121 | 6/1993 | Dickie et al. | 206/591 |
| 5,303,820 | 4/1994 | Comtois . | |
| 5,386,911 | 2/1995 | Payne | 206/591 |
| 5,522,539 | 6/1996 | Bazany | 206/586 |

FOREIGN PATENT DOCUMENTS

| | | |
|---|---|---|
| 1364548 | 1/1988 | U.S.S.R. . |
| 9416968 | 8/1994 | WIPO . |

*Primary Examiner*—Jacob K. Ackun
*Attorney, Agent, or Firm*—Linda Flewellen Gould

[57] ABSTRACT

A specialized container is ideally suited to protecting electronic boards being transported from injury due to physical shock and electrostatic shock. The container consists of an outer shell and at least one insert. The outer shell and each insert can be made of electrostatic discharge protective corrugated fiberboard material. The outer shell is basically a rectangular prism, suitable for receiving a electronic board with a substantially rectangular base. A first insert is easily placed within the outer shell, consisting of a platform on which the board will rest and at least one resilient and compressible support member extending down from the platform to the bottom panel of the outer shell. To provide further protection for the board, a second insert may be placed on top of the first, with a tab extending downward from the second insert to a slit in the first insert platform. The board then rests on the platform of the second insert. This second insert may have one or more extension members which cushion the sides and top of the board.

19 Claims, 4 Drawing Sheets

CONTAINER WITH SHOCK-ABSORBING INSERT

BACKGROUND OF THE INVENTION

1 Technical Field

This invention pertains to a method of protecting items being transported in a container. The container is designed to hold products with a substantially rectangular shaped base of a variety of sizes, such as circuit boards.

2 Background Art

Circuit boards and other high technology cards are used in many industries, offices, and other areas, and thus must frequently be transported to a myriad of locations. These boards require specialized containers to protect both against injury caused by the typical physical impacts associated with transportation, and to protect against damage from electrostatic discharge. The present invention is well suited to secure a board within an electrostatic discharge protected container, in such a manner that it is protected against most of the bumps and collisions that typically occur during transport. Furthermore, the present invention is designed to allow boards of a variety of sizes to be placed into the same container, eliminating the need to produce and store a specially shaped container for each size board being shipped.

A number of specialized containers are known in the prior art. For example, a package described in U.S. Pat. No. 5,121,838 to Dickie includes a rectangular shell with an insert that folds to create a rectangular inner structure. The insert is intended to surround a card-like item on four sides by four articulated panels. Slots are formed in the articulated panels into which the card-like item is secured. Although this package is useful for its intended purpose, each such package will accommodate an item of only a particular size, since the insert must surround the card-like item, and because the item actually fits into slots formed in the articulated panels.

The prior art includes other packages intended specifically for the transportation of circuit boards. U.S. Pat. No. 5,223,121 to Dickie et al. describes a carton with interior panels which are used to clamp a circuit board of a particular size into place within the carton.

Other packages known in the prior art are designed to provide shock absorption to protect a variety of fragile products, although not necessarily accommodating the substantially flat shape of circuit boards and other card-like items. U.S. Pat. No. 2,742,219 to Van Antwerpen discloses a shock absorbing filler to be placed beneath a fragile item during transport. Similarly, other shock absorbing box fillers are described in U.S. Pat. No. 987,958 to Clenny et al, U.S. Pat. No. 2,401,765 to Kuhlman, U.S. Pat. No. 2,984,399 to Gaulke, U.S. Pat. No. 1,817,286 to Beaman, W.O. Patent No. 94/16968, SU Patent No. 1364-548-A, and U.S. Pat. No. 2,979,248 to Washington. Although each of these carton fillers serves a useful purpose, they are not well suited to providing the protection needed for card-shaped electronic products. Furthermore, many of these shock absorbing fillers are difficult to assemble and place into a container, resulting in the expenditure of valuable man-hours to package products for shipping.

Transportation of electronic products requires safeguards not only against injury caused by physical shock and collision, but also against damage created by electrostatic discharge. Packaging known in the prior art with the purpose of alleviating this concern includes the electrostatic discharge pad described in U.S. Pat. No. 4,798,290 to Bradford, the convoluted foam liner of U.S. Pat. No. 4,241,829 to Hardy, and the molded plastic support frame of U.S. Pat. No. 5,303,820 to Comtois. The use of foam and plastic is environmentally disadvantageous, a concern which is addressed by the present invention. Foam loses its electrostatic protective quality in a short time, sometimes as little as two years, and it can be difficult to dispose of, since burning foam produces noxious fumes.

When electronic products are transported in large quantities, it is particularly helpful to identify each product by a bar code or other classifying marks. Identification is then expedited if such marks can be viewed while the product is still within the packaging. The prior art includes certain packaging designed to accommodate this need when transporting integrated circuits, including transparent windows described in U.S. Pat. No. 4,463,851 in to Cecil and in U.S. Pat. No. 4,327,832 to De Matteo.

A method of packaging substantially flat rectangular products is needed, which protects the product against physical impact and electrostatic discharge. Ideally, the package should be easily assembled from materials that do not detrimentally affect the environment. Furthermore, such a container will be most advantageous if it accommodates a variety of sizes of products, and can be efficiently loaded with such products.

DISCLOSURE OF THE INVENTION

Summary of the Invention

An object of the present invention is to provide a method of transporting substantially flat and generally rectangular shaped products, while protecting those products from damage due to physical shocks, collisions, and being dropped. Ideally, the container used in this method should also protect such products from injury due to electrostatic discharge. The container claimed herein protects the contents of that container from both physical and electrostatic injury, establishing important protection for expensive electronic products being shipped within the container.

Another object of the present invention is to provide packaging which does not create environmental problems. Circuit boards and similar products are frequently shipped in boxes containing foam or plastic cushioning, which fillers create environmental hazards both with respect to their production and disposal after use. The present invention can be made entirely of corrugated fiberboard, which may be produced from recycled paper products, and which can be recycled again. Because boards of differing sizes will fit within one container, the container is easily reusable for transportation of other boards, further decreasing the risk of detrimental environmental effects.

Yet another object of this invention is to provide a container which is suitable for protectively transporting such products, which container is easy and quick to assemble and load, to reduce the expense and time associated with packaging the electronic product. Assembly of the present invention can be accomplished by simply placing a shock absorbing insert inside a specialized rectangular box, and pressing down on that insert until it is secured in place. Having secured the insert in the rectangular box, the substantially flat board to be transported is easily placed on top of the insert, without having to be positioned in any particular manner. A second insert is optionally added, prior to inserting the board, and the box can be closed in a standard fashion. This simple process is very efficient in terms of time required to secure the board in a protected fashion for transport.

A particularly important object of the present invention is to provide a container which can be used to transport substantially rectangular shaped products of a variety of sizes. As has already been mentioned, it is advantageous to reuse such containers, both from an economic stand-point of purchasing fewer boxes, and to serve an environmental goal of avoiding disposal of used boxes. It is more likely that such containers will be reused if they will accommodate a variety of sizes of boards. Furthermore, manufacturers of boards can more efficiently arrange for shipping of their products if different boards will fit into the same container, rather than having to maintain a separate set of containers for each board produced.

The method of packaging electronic boards and other similarly shaped products according to the present invention involves a specialized container with at least one shock absorbing insert. The outer shell of the container will be substantially a rectangular prism, to accommodate a board which has a flat rectangular base on which various components have been mounted and thus rise above the flat base. Because the shock absorbing insert will serve to hold the board in place, a container of a particular size can hold a variety of different sizes of boards, provided that each such board has dimensions smaller than the interior dimensions of the container.

As is common in the prior art, it is useful for the container to be equipped with a top which folds back from the outer shell of the container, hinged by a fold between the top of the outer shell and the back panel of the outer shell. An exterior front panel is connected to the top of the outer shell, and hinged by a fold line, opposite the fold line by which the top connects to the back panel of the outer shell, so that the exterior front panel can be moved into place over and adjacent to an interior front panel, when the top is lowered to close the container after a board has been placed into the container. The exterior front panel is conveniently fitted with side flaps which can be inserted into slots formed in the side panels of the outer shell, to secure the top panel and exterior front panel in a closed position.

The outer shell and each insert can advantageously be constructed of an electrostatic discharge protective corrugated fiberboard. When the container is closed, a fully enclosed Farrady cage is created, so that electrostatic are prevented from reaching the products inside the container. The material chosen for construction of the container ideally will be either electrostatic shielding or electrostatic dissipative in nature.

A first insert may be easily placed within the outer shell to create a cushioned platform on which a board may rest. The first insert consists of a platform and at least one resilient and compressible support which extends from the platform down to the bottom panel of the outer shell. Typically, two supports will be used, with each support extending downward from opposite sides of the platform. Each support may conveniently comprise an accordion folded member, which is compressible along the fold lines, but tends to move back to an original position after compression. To allow ease of placement of the first insert within the outer shell, while permitting the support members to be compressible and to return to their original position in response to physical shocks, multiple tabs extend from the platform of the first insert into slits formed in the side or back panels of the outer shell. Each slit is wide enough to receive a single tab, and is tall enough to allow the tab to move up and down as the support member compresses and expands.

To further secure the board within the container, it is useful to construct the top panel of the outer shell so that side flaps extend from the top panel, fitting inside and adjacent to the side panels of the outer shell when the top is in a closed position. By cutting the side flaps to a height that reaches down almost to the first insert platform when the container is closed, the side flaps can be made to engage the board resting on the first insert, and provide stabilization of that board. The side flaps may advantageously have an indentation toward the front of the container, to allow for placement of a face plate of the board resting on the first insert.

A slit formed in the platform of the first insert, substantially parallel with and near the front panel of the outer shell, is suitable for receiving the bottom of a face plate mounted on the board. When the board is placed on the platform, the face plate tends to fit into this slit, further securing the board resting on the platform.

Especially when transporting relatively large boards, it is useful to place a second insert on top of the first insert, to further secure the board within the container. The second insert can be easily held in place with respect to the first insert by placing tabs extending down from the second insert into slits formed in the platform of the first insert.

A particularly protective and simple-to-use second insert consists of a platform suitable for supporting the board and extension members extending upwards from opposite sides of the second insert platform, to form protective cushions between the board and the top of the container on opposite sides of the board. The platform of the second insert may easily rest directly on the platform of the first insert, with tabs extending downward from the second insert platform into slits formed in the first insert platform. Ideally, each extension member may consist of multiple segments formed by fold lines in the extension member, the segments oriented as follows:

a. a first segment extending upwards from the second insert platform, parallel to each side panel of the outer shell, then b. a second segment extending away from the adjacent side panel, between the board lying on the platform and the top panel of the outer shell, then c. a third segment extending back toward the adjacent side panel, above the second segment, and then d. a fourth segment extending back toward the platform, between the first segment and the adjacent side panel.

A variety of slits and indentations may be formed in the first and second inserts to accommodate various parts mounted on a board to be carried within the container. For example, a slit may be formed in the first and second segments of an extension member of the second insert, to allow a portion of the first and second segments to be pushed back towards the adjacent side of the outer shell, when needed to accommodate a large component mounted on the board. When a board without such a component is placed in the container, all of the extension member extends above the board, since the extension member is pressed back toward the sides of the outer shell only if a component mounted on the board interferes with the extension segments.

The outer shell and each insert can advantageously be constructed of electrostatic discharge protective corrugated fiberboard. Suitable materials include conductive materials that are static shielding in nature, or non-conductive materials that are electrostatic dissipative. If electrostatic dissipative materials are used, an electrostatic charge contacting the container will be dissipated along the container, without affecting the contents. Corrugated fiberboard materials are available which have an electrostatic discharge protective quality for approximately ten years. In comparison, foam products may not protect from electrostatic discharge after two or three years, resulting in the earlier disposal of foam products. To prevent stacked containers from slipping and falling, it may be useful to treat each container with an anti-slip coating.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

The present invention involves a method of transporting substantially rectangular based products, such as circuit boards and high technology cards, in a manner that protects the products from both physical and electrostatic shocks.

In the following description, numerous specific details are set forth, in order to provide a thorough understanding of the present invention. It will be obvious, however, to one skilled in the art that the present invention may be practiced without these specific details. Some well-known methods and structures have not been set forth in order not to unnecessarily obscure the description of the present invention.

Figure 1:
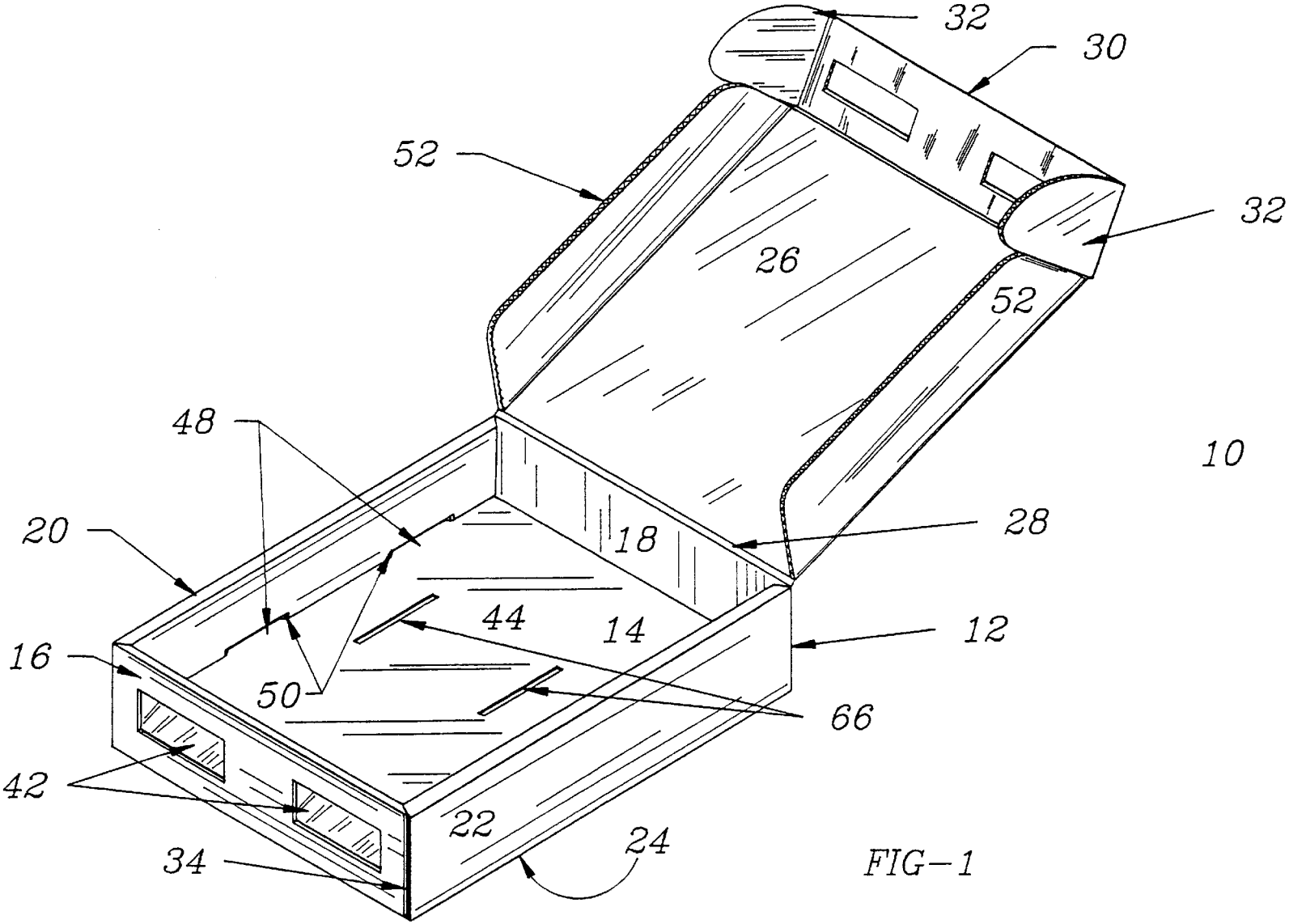
FIG. 1 is perspective view of a container with a single shock-absorbing insert, shown in an open position, according to the present invention.

The method of protecting a substantially rectangular product of the present invention can be better understood by reference to FIG. 1. A container 10 has an outer shell 12 shaped as a rectangular prism and at least one specialized insert 14. The outer shell 12 has an interior front panel 16, back panel 18, left side panel 20, right side panel 22, bottom panel 24, and top panel 26. The top panel 26 may conveniently be connected to the back panel 18 at a fold line 28, allowing the top panel 26 to be moved between an open position as shown in FIG. 1 and a closed position in which the top panel 26 rests on top of the left and ride side panels 20, 22. A variety of means of securing the top panel 26 in a closed position are possible, including a customary method in which an exterior front panel 30 with side flaps 32 is connected to the top panel 26, so that the side flaps 32 may be inserted into slits 34 in the right and left side panels 20, 22 to secure the top panel 26 in the closed position.

The substantially rectangular board 36 to be transported may be a variety of shapes and sizes, provided that it is no bigger in length, width, and height than the interior dimensions of the outer shell 12. Such boards typically have a face plate 38 which extends above and below the substantially rectangular base 40 of the board. The face plate 38 may also have a greater width than the rectangular base 40. To accommodate this wider face plate 38, without providing excessive room in which the rectangular base 40 may slide around, the left and right side panels 20, 22 of the outer shell 12 may be specially fashioned. Each side panel 20, 22 may be formed so that the width of the side panel adjacent to the back panel 18 is larger than the width of that same side panel adjacent to the interior front panel 16, with each side panel 20, 22 thus having a gradually decreasing width from back to front. As a result, the internal width of the outer shell 12 will be larger adjacent to the interior front panel 16 than adjacent to the back panel 18.

Figure 2:
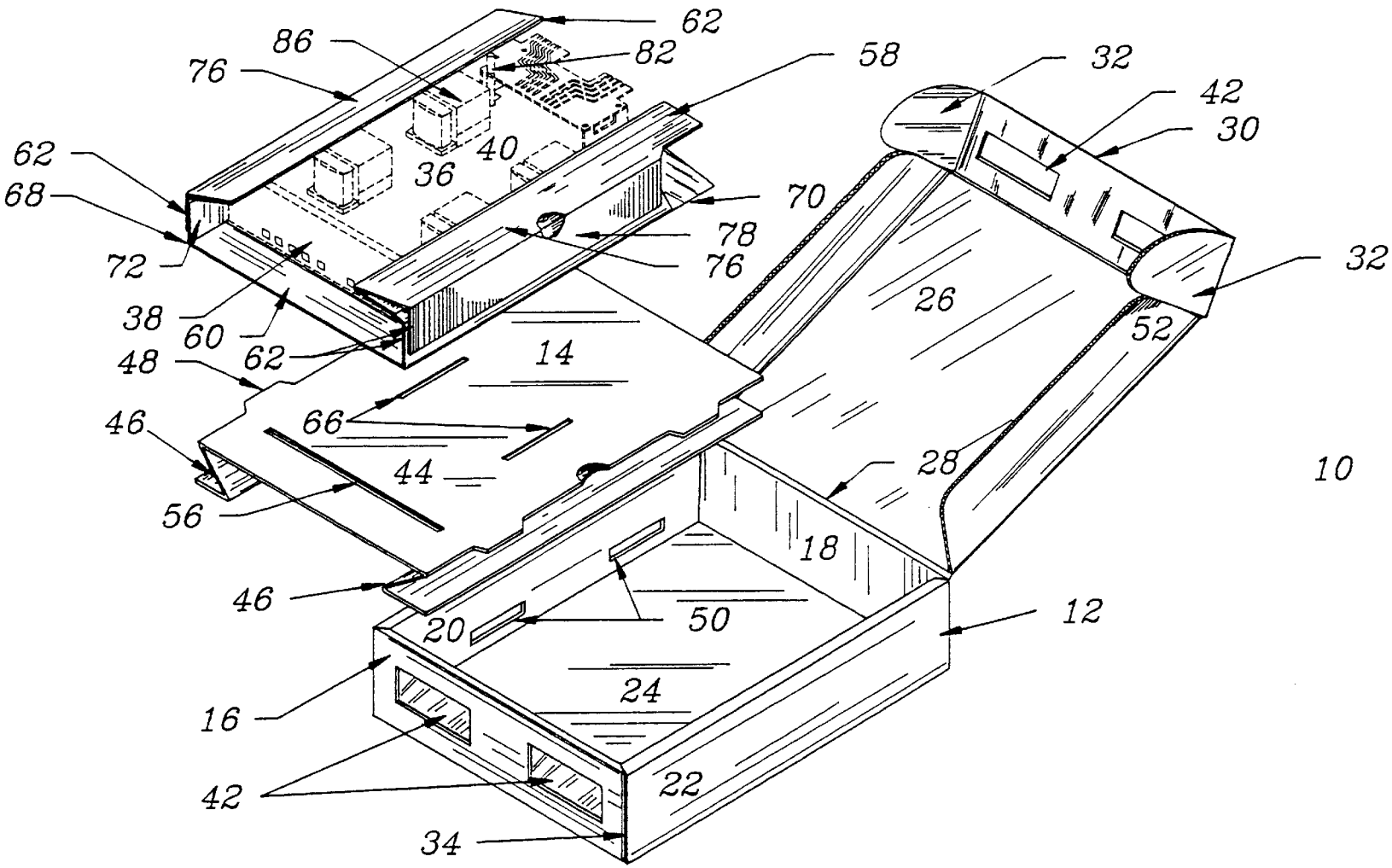
FIG. 2 is an exploded view of a container with two shock-absorbing inserts, showing the alignment of those inserts around a board to be transported, according to the present invention.

Some boards 36 are identified by bar code markings (not shown) on the face plate 38. To enable such markings to be viewed while the board 36 is in the container 10, a viewing window 42 may be formed in the exterior front panel 30 and in the interior front panel 16, as shown in FIG. 2.

Figure 4:
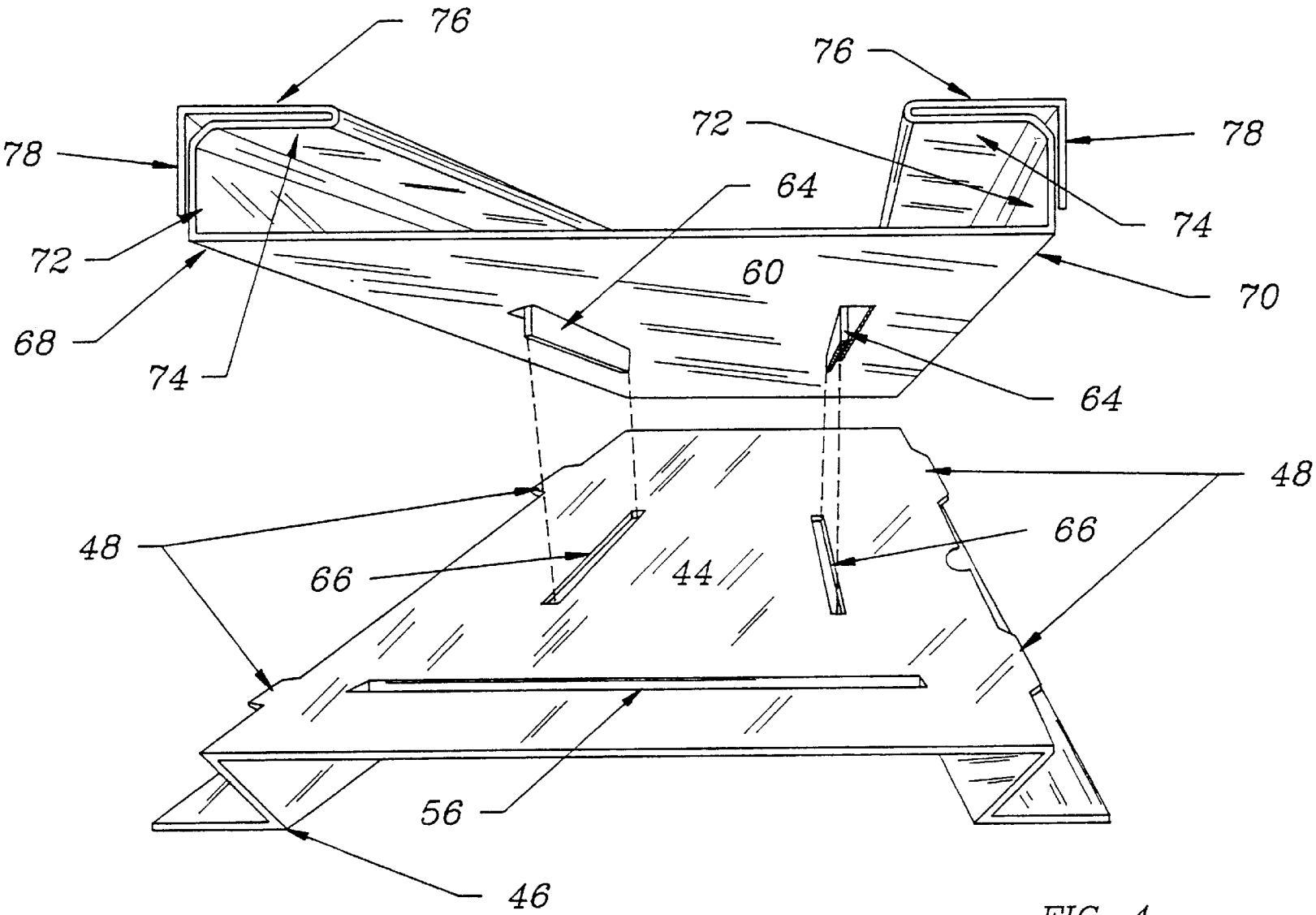
FIG. 4 is an exploded view of two shock-absorbing inserts suitable for inserting in a container according to the present invention.

The first insert 14 is designed to provide a cushioned surface on which the board 36 may rest within the outer shell 12. The first insert 14 consists of a first insert platform 44 and at least one resilient and compressible support member 46, as best shown in FIGS. 2 and 4. Ideally, two support members 46 extend downward from opposite sides of the platform 44 to engage the bottom panel 24 of the outer shell 12. The platform 44 is generally parallel to the bottom panel 24, and is suitable for supporting the board 36. Each support member 46 may conveniently consist of an accordion-pleated and thus compressible piece of corrugated fiberboard, attached to or extending from one edge of the platform 44. Typically the support member 46 will extend along the entire length of the platform 44.

To hold the first insert 14 in place within the outer shell 12, while permitting up and down movement of the insert 14, tabs 48 extend outward from the platform 44 and are inserted into slits 50 formed in the side panels 20, 22 and/or back panel 18. Each slit 50 is wide enough to snugly receive the corresponding tab 48, and is tall enough to allow that tab 48 to move up and down within the slit 50 as the support members 46 compress and expand.

Figure 3:
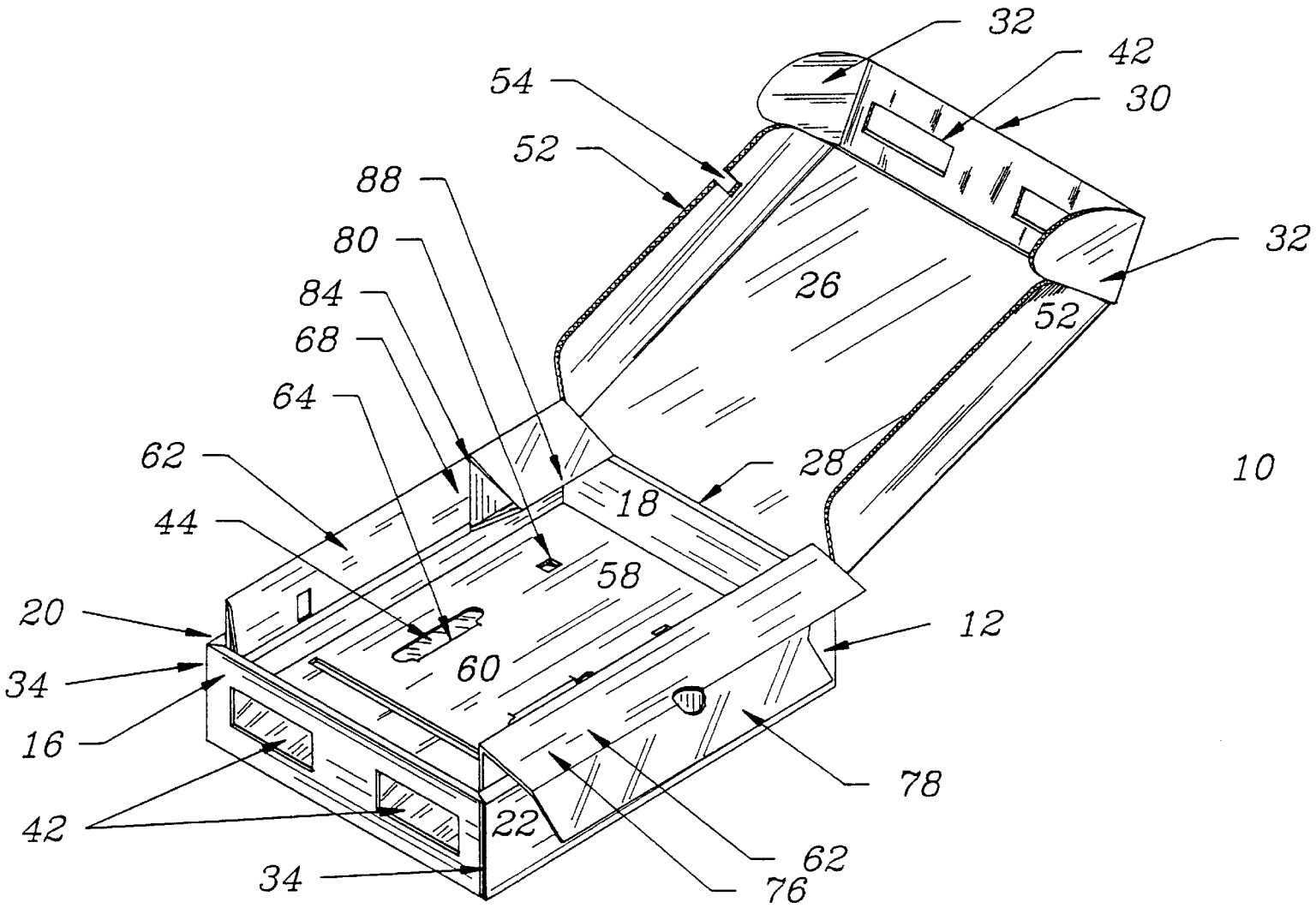
FIG. 3 is a perspective view of a container with two shock-absorbing inserts, in an open position, according to the present invention.

To further secure the board 36 resting on the platform 44, side flaps 52 may extend from the top panel 26, folding downward to fit inside and adjacent to the side panels 20, 22 when the top panel 26 is in a closed position. Ideally, each side flap 52 extends downward to touch the board 36 when the board rests on the platform 44. The side flaps 52 may be configured so that a front portion 54 of each side flap 52 extends only far enough down to engage the face plate 38, while the remainder of the side flap 52 extends further downward to contact the rectangular base 40, as shown in FIG. 3. The board 36 may also be held in place on the first insert 14 by providing a slit 56 in the first insert platform 44 near the front panel 16, as shown in FIG. 2, such slit 56 being of a size which will receive the face plate 38 when the rectangular base of the board 40 rests on the platform 44.

Ideally, to protect against not only physical injury to the board 36 but also the possibility of electrostatic damage, the outer shell 12 and insert 14 can be constructed of electrostatic discharge protected corrugated fiberboard material. Each container 10 may also be treated with non-slip coating to inhibit stacked containers from sliding off the stack.

As shown in FIG. 2, a second insert 58 may also be constructed of electrostatic discharge protected corrugated fiberboard material, and inserted within the outer shell 12 to provide further protection from physical shocks, particularly when transporting larger boards 36. The second insert 58 may advantageously consist of a second insert platform 60 and one or more extension members 62 extending upwards from the second insert platform 60. The second insert platform 60 can be easily be placed inside the outer shell 12 to rest on the first insert platform 44. To hold the second insert 58 in an optimal place within the outer shell 12, at least one tab 64 extends downward from the second insert platform 60 to removably fit within a corresponding slit 66 in the first insert platform 44, as shown in FIG. 4.

In a preferred embodiment illustrated in FIGS. 2 and 3, left and right extension members 62 extend upwards from opposite sides 68, 70 of the second insert platform 60. Each extension member 62 provides further cushioned protection to the board 36. The extension members 62 may comprise several segments each defined by fold lines in the extension member. For example, as shown in FIG. 4, an extension member may advantageously consist of: a first extension segment 72 extending upwards from the second insert platform 60 parallel to each side panel 20, 22; a second extension segment 74 extending away from the adjacent side panel 20 or 22 between the board 36 and the top panel 26; a third extension segment 76 extending above the second extension segment 74 back towards the adjacent side panel 20 or 22; and a fourth extension segment 78 extending toward the bottom panel 24 between the first extension segment 72 and the adjacent side panel 20 or 22. When the extension member 62 is so configured, the second insert 58 cushions the board 36 from injury which might otherwise be caused by jarring against the adjacent side panel 20, 22 or the top panel 26. When each extension member 62 consists of segments which are formed by folding the corrugated fiberboard material from which the extension 62 is made, each extension 62 is compressible and resilient, and tends to resume its initial position after physical shock causes temporary compression.

Numerous slits and holes may be formed in the first insert 14 or the second insert 58 to accommodate various features and components 86 mounted on differing boards 36. For example, as shown in FIG. 3, holes 80 may be formed in the second insert platform 60 into which may be inserted posts 82 extending from a board 36. Also as shown in FIG. 3, a slit 84 may be formed in first and second extension segments 72, 74 of an extension member 62, to allow flexibility in the placement of those extension segments 72, 74. A segment 88 of the extension member 62 may be folded downward to fit between components 86 and the back panel 18, to prevent the board 36 from being jostled within the container 10. Alternatively, if components 86 are so large as to preclude the segment 88 from being pushed down to engage the base 40 of the board 36, the large component 86 may push the segment 88 away from the board 36, enabling the container 10 to accommodate boards 36 with such large components 86.

The invention has been described in detail with particular reference to preferred embodiments thereof. As will be apparent to those skilled in the art in the light of the

LEGEND

CONTAINER WITH SHOCK ABSORBING INSERT

10 Container 58 second insert

12 Outer shell 60 second insert platform

14 First insert 62 second insert extensions

16 interior front panel 64 tab downward from second insert

18 back panel 66 slit in first insert to receive tab

20 left side panel 68 left side of second insert platform

22 right side panel 70 right side of second insert platform

24 bottom panel 72 first extension segment

26 top panel 74 second extension segment

28 Fold line between top and 76 third extension segment back panels 78 fourth extension segment

30 Exterior front panel 80 hole to receive posts

32 Exterior front panel side flaps 82 posts from board

34 Slits for receiving front 84 slit in extension member panel side flaps 86 component on board

36 Board being transported 88 portion of extension member behind

38 face plate slit

40 rectangular base

42 viewing windows

44 first insert platform

46 first insert support member

48 tabs from platform

50 slits to receive tabs

52 side flaps from top panel

54 raised front portion of side flap

56 slit in first insert to hold face plate accompanying disclosure, many alterations, substitutions, modifications, and variations are possible in the practice of the invention without departing from the spirit and scope of the invention.

We claim:

1. A container for holding a substantially rectangular product, comprising:

a. An outer shell having an interior front panel, a back panel, left and right side panels, a bottom panel, and a top panel, said top panel being movable between a closed position and an open position, b. A first insert comprising a first insert platform suitable for supporting the product, and at least one resilient and compressible support member, wherein said first insert can be placed inside said outer shell with said first insert platform substantially parallel to said bottom panel when said support member rests on said bottom panel, c. A plurality of tabs extending from said first insert platform and parallel with said first insert platform, and d. A slit formed in a side or back panel to receive each tab, said slit being wide enough to snugly receive said tab, and tall enough to allow said tab and the first insert platform from which said tab extends to move up and down as the support member compresses and expands.

2. The container of claim 1, further comprising a closure means for securing said top panel of said outer shell in the closed position.

3. The container of claim 2, wherein said closure means further comprises:

a. said top panel being connected by a hinge to said back panel, and b. an exterior front panel connected by a hinge to said top panel opposite said back panel, said exterior front panel having front panel side flaps which snugly fit into slits formed in said side panels when said top panel is moved to the closed position above and adjacent to the side panels, in which closed position said exterior front panel is adjacent to said interior front panel.

4. The container of claim 1, wherein a plurality of resilient and compressible support members are attached at opposite sides of said platform, extending downward to rest upon said bottom panel.

5. The container of claim 1, further comprising top panel side flaps extending from said top panel, which top panel side flaps fit inside and adjacent to said left and right side panels when the top panel is in the closed position.

6. The container of claim 5, wherein said top panel side flaps extend downward to contact said product when the top panel is in the closed position.

7. The container of claim 6, wherein a portion of said top panel side flaps extend downward to contact a face plate of the product and a portion of said top panel side flaps extend further downward to contact a substantially flat rectangular base of the product.

8. The container of claim 1, further comprising a slit formed in said first insert platform suitable for receiving a face plate of the product when a substantially flat rectangular base of the product rests on said first insert platform.

9. The container of claim 3, further comprising a viewing window formed in said exterior front panel and a viewing window formed in said interior front panel.

10. The container of claim 1, wherein said outer shell and said first insert are constructed of electrostatic discharge protective corrugated fiberboard material.

11. The container of claim 10, wherein said outer shell is treated with non-slip coating.

12. The container of claim 1, wherein each side panel has a gradually decreasing width resulting in an interior width of the outer shell adjacent to the interior front panel being greater than an interior width of the outer shell adjacent to the back panel.

13. The container of claim 1, further comprising a second insert removably placeable on said first insert.

14. The container of claim 1, further comprising at least one second insert slit formed in said first insert platform.

15. The container of claim 14, further comprising a second insert removably placeable on top of said first insert, so that at least one tab extending downward from said second insert fits into said second insert slit.

16. The container of claim 13, wherein said second insert further comprises:

a. a second insert platform suitable for supporting the product, and b. left and right extension members extending from opposite sides of said second insert platform.

17. The container of claim 16, wherein each extension member further comprises:

a. first extension segment extending upwards from said second insert platform parallel to each side panel, b. second extension segment extending from said first extension segment, away from an adjacent side panel, between the product and the top panel when the product rests on said second insert platform, c. third extension segment extending from said second extension segment above said second extension segment toward the adjacent side panel, and d. fourth extension segment extending from said third extension segment toward the bottom panel between the first extension segment and the adjacent side panel.

18. The container of claim 17, wherein each extension segment is connected to adjacent extension segments by a hinge which allows each extension member to be compressible and resilient.

19. The container of claim 18, wherein a slit is formed in said first extension segment and second extension segment of at least one extension member, so that a segment of said first extension segment can be folded downward to fit between the product and the back panel, or can be folded upward to accommodate a product which extends from said interior front panel beyond said slit toward said back panel.

* * * * *